US007300324B2

(12) United States Patent
Garwood

(10) Patent No.: US 7,300,324 B2
(45) Date of Patent: Nov. 27, 2007

(54) MANUAL PROPULSION MECHANISM

(75) Inventor: Clint Garwood, Chicago, IL (US)

(73) Assignee: Hydro-Blade, Inc., Bloomingdale, IL (US)

( * ) Notice: Subject to any disclaimer, the term of this patent is extended or adjusted under 35 U.S.C. 154(b) by 0 days.

(21) Appl. No.: 11/308,110

(22) Filed: Mar. 7, 2006

(65) Prior Publication Data

US 2007/0212954 A1 Sep. 13, 2007

(51) Int. Cl.
*B63H 16/00* (2006.01)

(52) U.S. Cl. ..... 440/25; 440/102

(58) Field of Classification Search ..... 440/25, 440/102, 101

See application file for complete search history.

(56) References Cited

U.S. PATENT DOCUMENTS 788,884 A * 5/1905 Buff ..... 440/102
823,075 A * 6/1906 Petrich et al. ..... 416/74
1,533,023 A 4/1925 Meredith
2,297,493 A 9/1942 Pomilio
3,242,898 A 3/1966 Livaudais
3,835,494 A 9/1974 Dougherty
4,157,597 A 6/1979 Trebnick
4,846,743 A 7/1989 Ping-chuan
4,952,184 A 8/1990 Graziano
5,080,621 A 1/1992 Nayes
5,194,023 A 3/1993 Stone
5,458,514 A 10/1995 Hsia
5,669,793 A 9/1997 Walton
5,697,822 A 12/1997 Souter
6,595,813 B1 7/2003 Lekhtman
6,736,688 B1 5/2004 Garwood
6,764,363 B2 7/2004 Rosen
6,848,958 B2 2/2005 Garwood

FOREIGN PATENT DOCUMENTS

JP 55-119588 9/1980

* cited by examiner

*Primary Examiner*—Stephen Avila
(74) *Attorney, Agent, or Firm*—Joseph R. Lanser; Seyfarth Shaw LLP

(57) ABSTRACT

A device for propelling a personal watercraft comprising a base having an inner channel and an outer channel. A fin is disposed substantially adjacent to the base and is rotatable relative to the base. The fin has an inner protrusion adapted to moveably engage the inner channel, and an outer protrusion adapted to moveably engage the outer channel. A yoke is disposed substantially adjacent to base and adapted to engage the inner protrusion. When a force is applied to the yoke along a first vector, the inner and outer protrusions move in reciprocal directions causing the fin to rotate.

21 Claims, 15 Drawing Sheets

MANUAL PROPULSION MECHANISM

RELATED APPLICATIONS

This application claims the benefit of the filing date of co-pending U.S. provisional patent application No. 60/622,147, filed on Mar. 16, 2005.

BACKGROUND OF THE INVENTION

The present invention relates generally to manually-propelled, personal watercraft devices and, more particularly, to mechanisms for propelling personal watercraft devices.

It is well known that a user can propel a watercraft using a hand-held paddle or fin. For example, in a canoe, the user holds a fin or paddle in his hands and, with in a well-known rowing motion, propels the canoe in the desired direction by creating water resistance against the paddle by drawing the paddle through the water with the blade disposed substantially perpendicular to the direction of travel.

However, propelling watercraft with hand-held fins or paddles has several disadvantages. For example, a user can drop or loose a fin or paddle because it is not properly secured to the watercraft; propulsion using hand-held fins or paddles can be inefficient if the user lacks a certain degree of skill because, with such devices, users must control the rowing or stroking motions themselves with simultaneously alternating hand and arm movement, wherein a user may fail to use the proper stroke technique and thereby fail to substantially maximize the efficiency of the propulsion forces caused by the fin or paddle. Further, devices using hand-held fins or paddles are limited to propulsion by hand and arm movement and cannot be easily retrofitted for leg propulsion.

BRIEF SUMMARY OF THE INVENTION

The present invention is a manual propulsion mechanism to be used on manually propelled transportation devices, such as, for example, watercrafts, which facilitates either forward or rearward movement of the device. For example, the present invention may be used on relatively small watercrafts such as inflatable floats, kickboards, kayaks, personal flotation devices, life vests and floating lounge chairs. Yet, despite the relatively compact design of the present invention, the propulsion mechanism may also be used with larger watercraft. Still alternately, the propulsion mechanism of the present invention may be coupled to a plurality of other propulsion mechanisms for a plurality of users to simultaneously exert force on the propulsion mechanisms, such as, for example, with skulling.

The present invention, in part, mechanizes the conventional paddle stroke of a user to maximize the efficiency of the paddling position by, for example, keeping the paddle substantially perpendicularly aligned in relation to the watercraft during the propulsion stroke so the user's input energy may be efficiently transferred to the paddle, thus causing such energy to efficiently impart propulsion forces. In an embodiment, the propulsion mechanism also gives the user the option to propel the watercraft by hands/arms only, legs only or simultaneously with legs and hand/arm motions.

In an embodiment, the propulsion mechanism of the present invention is adapted to be coupled to watercraft having a flotation body. In another embodiment, first and second propulsion mechanisms may be respectively coupled to first and second sides of the body.

In an embodiment, the propulsion mechanism includes a track disposed on the body substantially parallel to the longitudinal axis thereof and a base that is slideably coupled to the track, such that the base may move between a first and second position relative to the body. The base includes inner and outer channels, each forming a substantially arcuate path in inverted relation to each other. The base may also include longitudinally aligned front and rear brake slots, each being disposed substantially parallel to the longitudinal axis and each having first and second stops. The propulsion mechanism includes a brake pin that is adapted to slideably move within either of the brake slots between the first and second stops. In an embodiment, when the front brake slot is engaged, forward propulsion is possible, and when the rear brake slot is engaged, rearward propulsion is possible.

The propulsion mechanism further includes a fin disposed adjacent to the underside of the base and having a blade extending substantially downwardly toward the water. The fin includes an inner protrusion with an inner guide pin and an outer protrusion with an outer guide pin. The inner guide pin is adapted to slide within the inner arcuate channel and the outer guide pin is adapted to slide within the outer arcuate channel.

In an embodiment, a yoke structure may be disposed substantially above the base. The yoke is adapted to engage the inner guide pin as the guide pin penetrates the inner channel of the base. The yoke is also penetrated, through an aperture therethrough, by the brake pin which selective engages the first or second brake slot.

Assuming that the base is disposed at the first position, a user initiates propulsion by applying a force to the yoke, causing the brake pin to move within the brake slot towards one of the stops, based upon the vector of the force. As the brake pin moves relative to the base, the inner guide pin moves within the inner arcuate channel and outer guide pin moves within the outer arcuate channel. The opposing movement of the inner and outer guide pins within the channels, which are invertedly spaced relative to each other, causes the fin to rotate toward a extended position, wherein the fin is disposed substantially perpendicular to the body. As the user continues to apply the force to the yoke, the brake pin abuts the stop, causing the base to slide along the track toward the second position along with the fin, which is disposed in the extended position, thus causing propulsion of the watercraft due to water resistance on the fin, until the base is disposed in the second position.

When the user reverses the force on the yoke, the brake pin moves within the brake slot towards the other of the stops. As the brake pin moves in the opposing direction, relative to the base, the inner guide pin moves within the inner arcuate channel and outer guide pin moves within the outer arcuate channel in the opposing direction. The opposing movement of the inner and outer guide pins within the channels, which are invertedly spaced relative to each other, causes the fin to rotate toward a retracted position, wherein the fin is disposed substantially parallel to the body. As the user continues to apply the force to the yoke, the brake pin abuts the stop, causing the base to slide along the track toward the first position along with the fin, which is disposed in the retracted position, thus allowing inertial forces of the watercraft to continue because the fin is substantially removed from the water.

In an embodiment, while one base is moved from the first position toward a second position, the other base may be reciprocally moved from the second position toward first position, similar to natural hand/arm motions of a runner where one hand moves forwardly while the other hand moves rearwardly.

BRIEF DESCRIPTION OF THE DRAWINGS

For the purpose of facilitating an understanding of the subject matter sought to be protected, there is illustrated in the accompanying drawings embodiments thereof, from an inspection of which, when considered in connection with the following description, the subject matter sought to be protected, its construction and operation, and many of its advantages, should be readily understood and appreciated.

DETAILED DESCRIPTION OF THE PREFERRED EMBODIMENT

Figure 1:
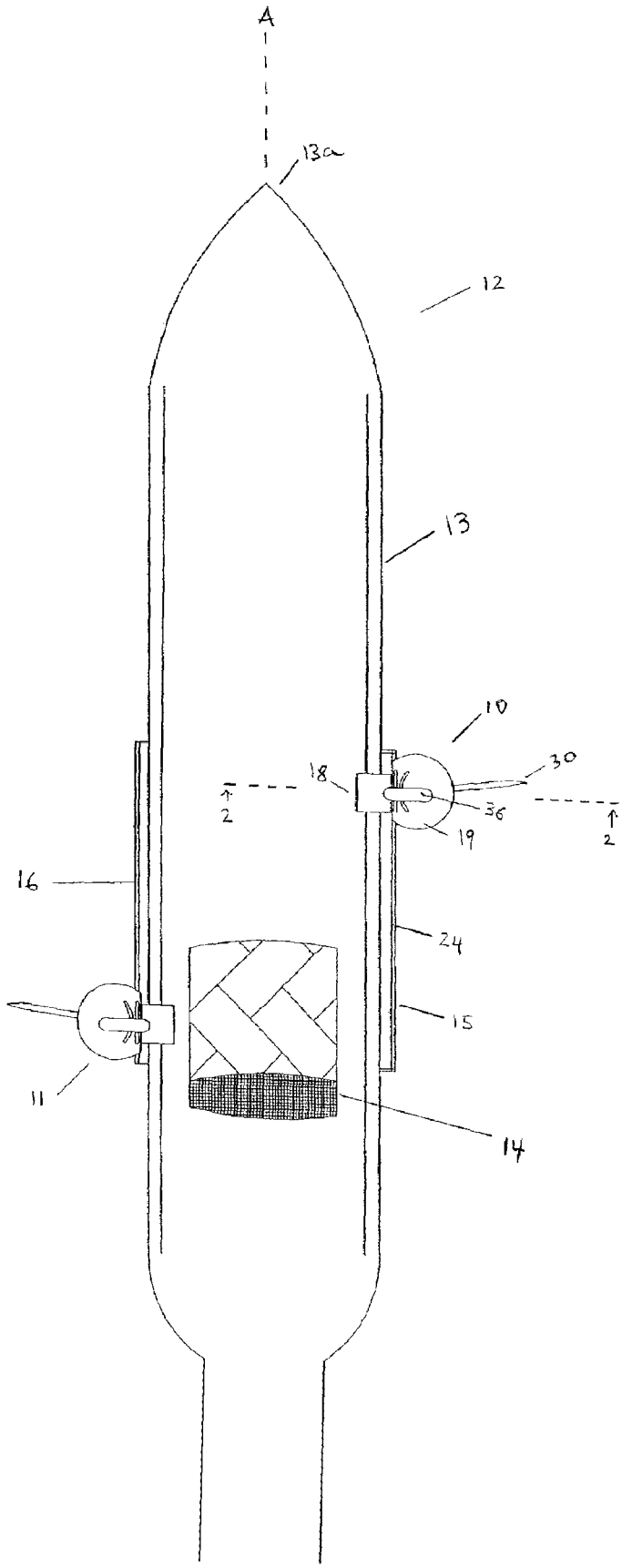
FIG. 1 is a top view of a watercraft incorporating first and second propulsion mechanisms of the present invention, with a first propulsion mechanisms being on opposing sides of the watercraft.

Referring to FIG. 1, an embodiment of the propulsion mechanism 10 of the present application coupled to a watercraft device 12 is shown. It will be appreciated that while the present invention is described as being coupled to a watercraft device, other manually propelled transportation devices may also be suitable for use with the propulsion mechanism of the present application. In an embodiment, the watercraft 12 includes a substantially buoyant body 13 having longitudinal axis A-A. The body further includes a front 13*a* and a rear 13*b*. A seat 14 may be disposed on the body 13 allowing a user (not shown) to sit on the watercraft 12 in a well-known manner. In an embodiment, the watercraft 12 may operate with dual propulsion mechanisms 10, 11, with a first propulsion mechanism 10 on one side of the body 13 and a second propulsion mechanism 11 on the opposing side of the body 13. The first and second propulsion mechanisms 10, 11 respectively slidably engage first and second tracks 15, 16, which are coupled to the body 13 substantially parallel to the longitudinal axis A-A. It will be appreciated that the first and second propulsion mechanisms 10, 11 are substantially identical to each other in form, design and structure. Accordingly, while only the first propulsion mechanism 10 is described in detail herein, the second propulsion 11 has substantially the identical form, design and structure.

Figure 2:
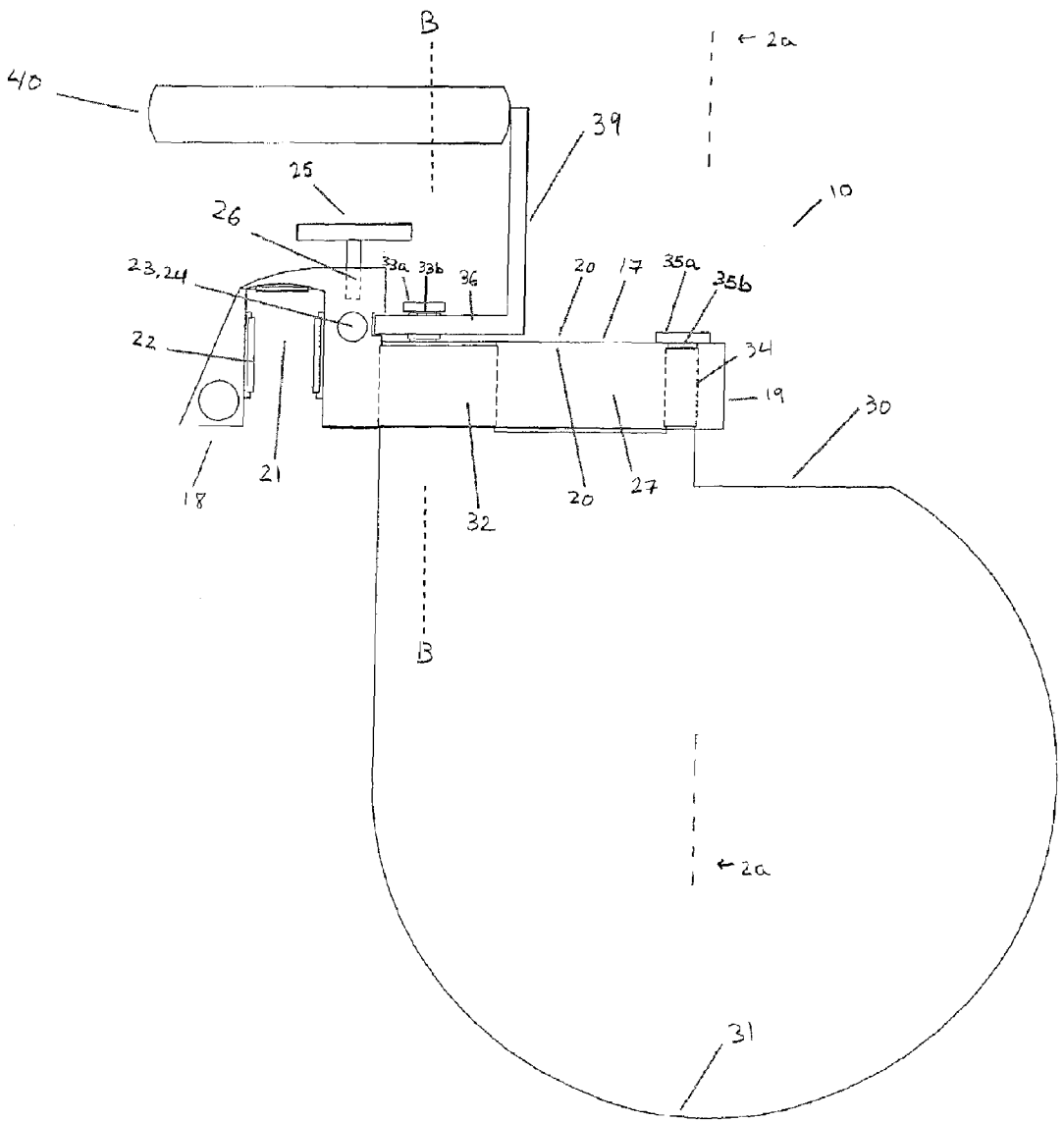
FIG. 2 is an enlarged side view of one of the propulsion mechanisms of FIG. 1 generally taken along line 2-2 of FIG. 1, showing the fin disposed substantially in the extended position.
Figure 2A:
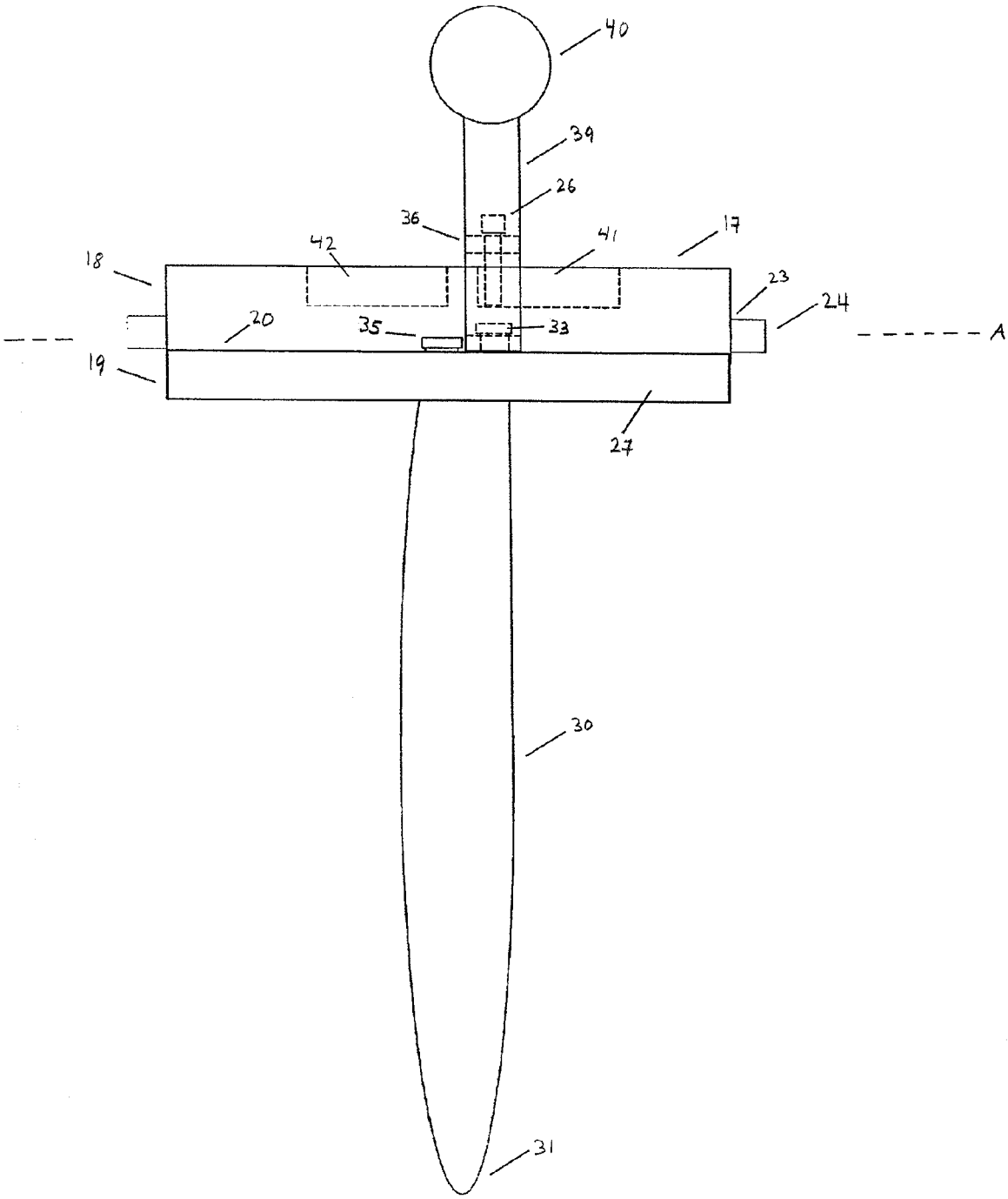
FIG. 2*a* is an enlarged side view of one of the propulsion mechanism of FIG. 2 generally taken along line 2*a*-2*a* of FIG. 2.

Referring also to FIG. 2, the propulsion mechanism 10 includes a base 17 having a panel 18 and a shoulder 19. The panel 18 forms a substantially inverted U-shaped duct 21 with a plurality of rollers 22 disposed in the walls therein, such that the base 17 may slidably engage track 15, thereby allowing the base 17 to move between first position and second positions relative to the body 13. In an embodiment, the first position may be located adjacent to the front of the body 13*a*, and the second position may be located adjacent to the rear of the body 13*b*.

Figure 3:
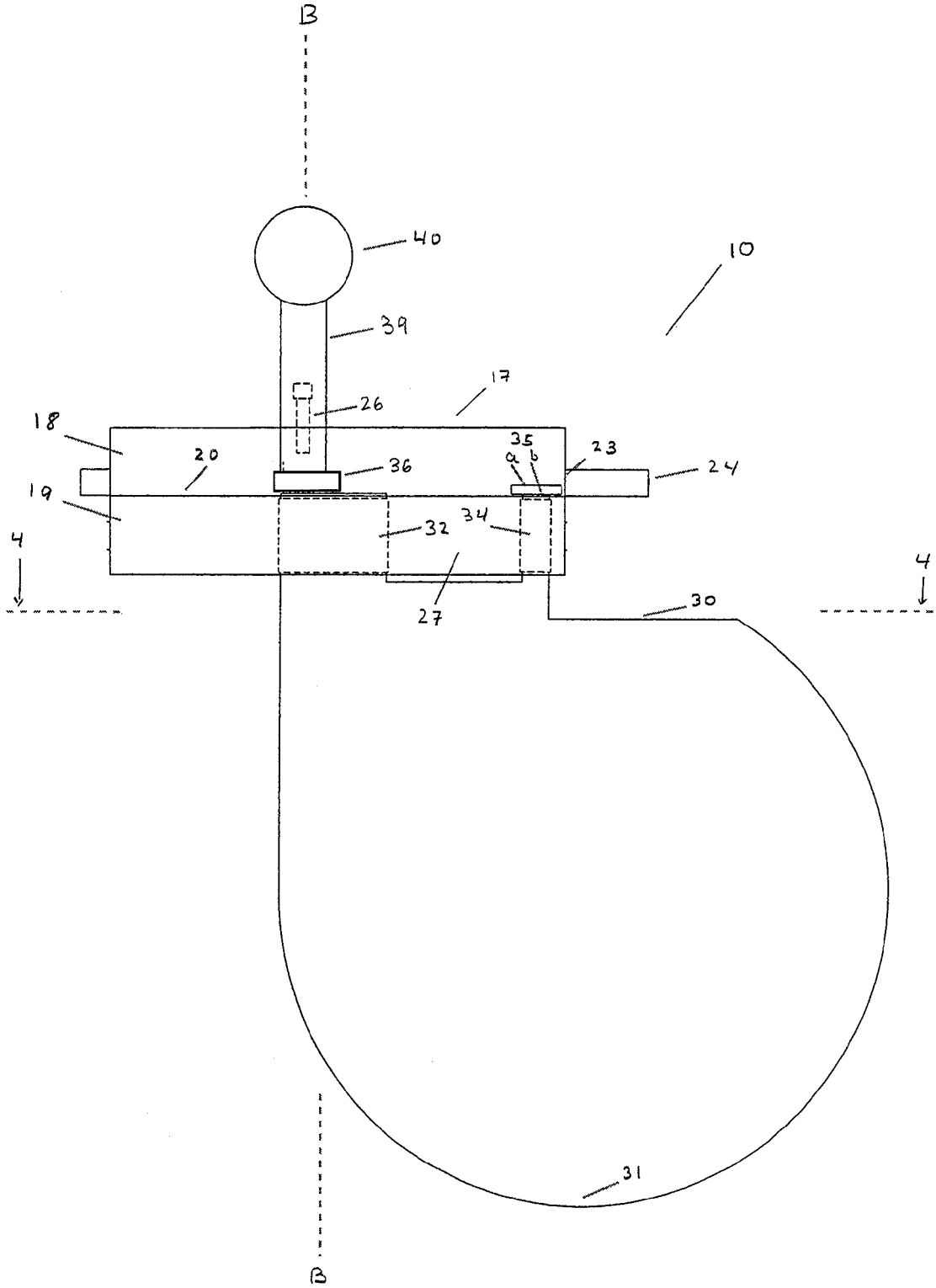
FIG. 3 is similar to FIG. 2*a*, but showing the fin disposed substantially in the retracted position.

Referring also to FIG. 3, in an embodiment, the panel 18 includes a guide bore 23 disposed adjacent to the duct 21. The guide bore 23 slidably receives a guide rail 24, which may be in the form of a substantially cylindrical rod. In an embodiment, the guide rail 24 is disposed adjacent to the track 15. The guide rail 24 creates additional stability as the base 17 slides relative along the track 15. In an embodiment, a clutch mechanism 25 may be slidably coupled to the panel 18 above the guide bore 23. The clutch 25 is coupled to a brake pin 26 which extends downwardly through the panel 18.

Referring also to FIGS. 4-7, the shoulder 19 includes a cap 20 which forms the upper surface of the shoulder 19. Beneath the cap 20, the shoulder 19 forms a cavity 27, which opens downwardly toward the water. The shoulder 19 further includes an inner channel 28 and outer channel 29 in spaced relation to each other and in communication with the cavity 27. In an embodiment, the inner channel 28 forms an arcuate path that is convex, relative to the longitudinal axis A-A, and the outer channel 29 forms an arcuate path that is concave, relative to the longitudinal axis A-A. The outer channel 29 may be of such a size and form, compared to the inner channel 28, to substantially form an arc of 180°, which invertedly opposes the inner channel 28.

The cavity 27 is adapted to receive a fin 30, which rotates about a first fin axis B-B. The fin 30 includes a blade 31 extending substantially downwardly toward the water. The fin 30 further includes an inner protrusion 32 and an outer protrusion 34, which are disposed in spaced relation relative to the fin 30 on a top side of the fin 30. In an embodiment, the inner protrusion 32 slidably engages the inner channel 28 with an inner guide pin 33 having a head 33*a* disposed above the cap 20, that is adapted to prevent the pin 33 from being inadvertently removed from the inner channel 23, and a shaft 33*b* that is coupled to inner protrusion 32 and is adapted to penetrate the inner channel 28. In an embodiment, the outer protrusion 34 slidably engages the outer channel 29 with an outer guide pin 35 having a head 35*a* above the cap 20, that is adapted to prevent the pin 35 from being inadvertently removed from the inner channel 29, and a shaft 35*b* that is coupled to outer protrusion 34 and is adapted to penetrate the outer channel 29.

In an embodiment, the propulsion mechanism 10 includes a yoke 36 disposed substantially adjacent to the cap 20. The yoke 36 may include an oblong yoke channel 37 having a longitudinal axis that is substantially perpendicular to the longitudinal axis A-A. The inner guide pin 33 may be adapted to slideably engage the yoke channel 37, such that the head 33*a* is disposed adjacent to an upper surface of the yoke 36 to prevent the pin 33 from being inadvertently removed from the yoke channel 37, and the shaft 33*b* of the inner guide pin 33 penetrates both the yoke channel 37 and inner channel 28. The yoke 36 may include an aperture 38 that is adapted to removably receive a brake pin 26.

The propulsion mechanism 10 may further include an upwardly standing extender 39. In an embodiment, the extender 39 may be rigidly coupled to the yoke 36 on one end and rigidly coupled to a handle 40 on the other end, such that a user may apply force to the yoke 36 by gripping and applying force to the handle 40. In another embodiment, the extender 39, yoke 36 and handle 40 may be formed of one unitary piece of material, such as, for example, fiberglass or a metal.

In an embodiment, the propulsion mechanism 10 is capable of propelling a watercraft either in a forwardly or rearwardly directed vector. In such embodiment, the panel 17 includes a front brake slot 41 and rear brake slot 42, each being substantially oblongly shaped and disposed substantially parallel to the longitudinal axis A-A, and each adapted to slidably receive the brake pin 26. The front brake slot 41 forms a first front stop 41*a* and a second front stop 41*b*. Similarly, the rear brake slot 42 forms a first rear stop 42*a* and a second rear stop 42*b*. The brake pin 26 is adapted to abut the first and second front stops 41*a*, 41*b* and first and second rear stops 42*a*, 42*b*. In an embodiment, when the brake pin 26 engages the front brake slot 41, forward propulsion, or forward drive, is possible, and when the brake pin 26 engages the rear brake slot 42, reverse propulsion, or reverse drive, is possible.

Figure 4:
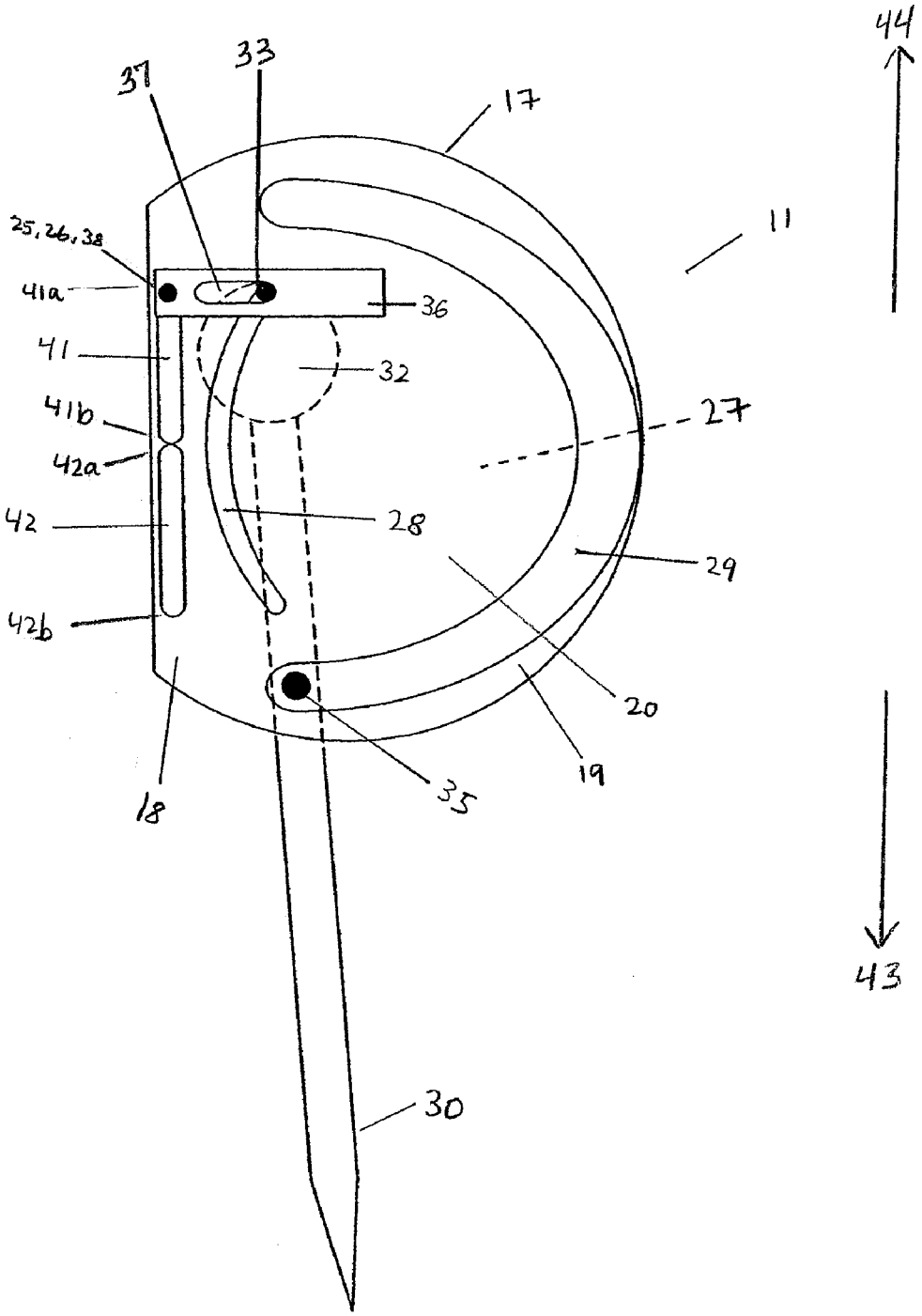
FIG. 4 is an enlarged cross-sectional top view of the propulsion mechanism of FIG. 3 generally taken along line 4-4 of FIG. 3, showing the brake pin engaged in the forward drive and showing the fin disposed substantially in the retracted position.
Figure 5:
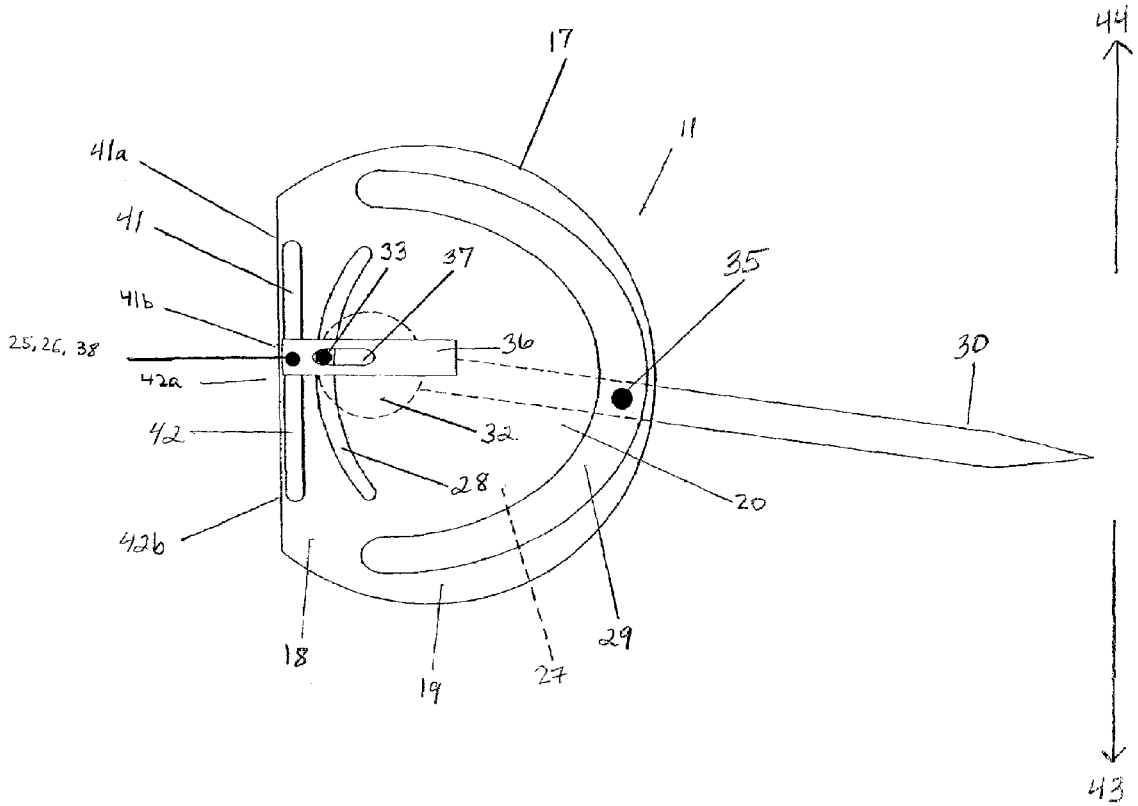
FIG. 5 is a view similar to FIG. 4, but showing the fin disposed substantially in an extended position.
Figure 6:
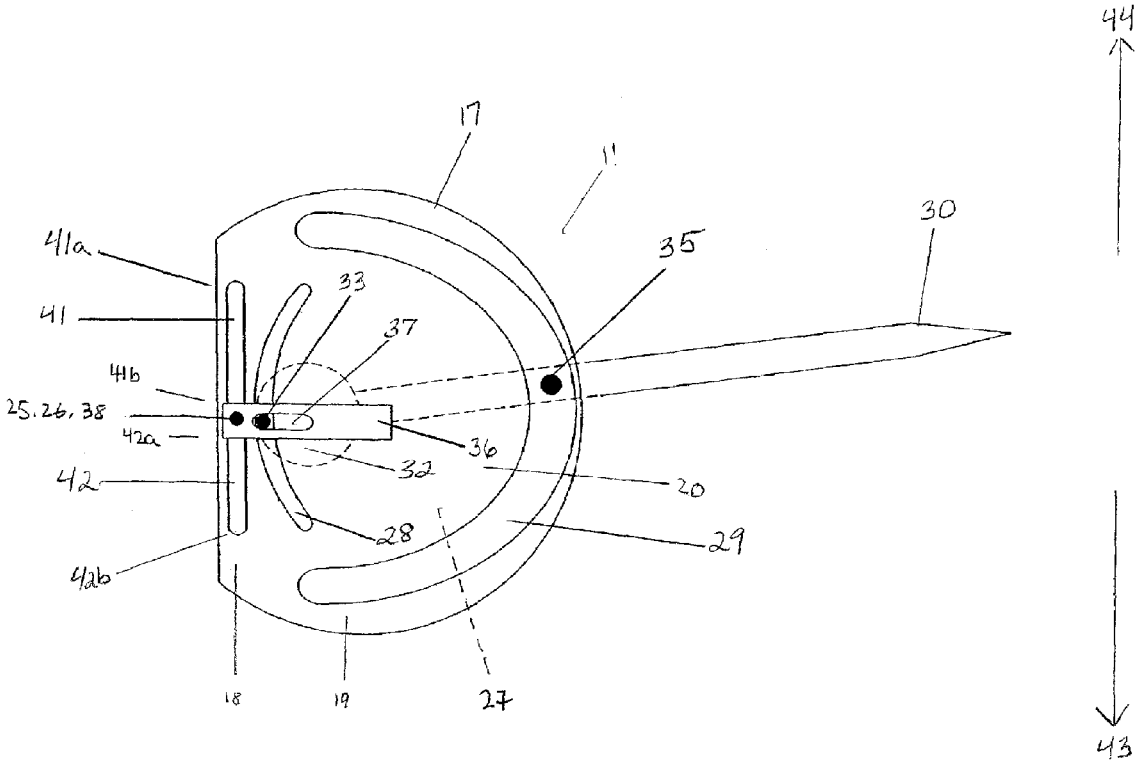
FIG. 6 is an enlarged cross-sectional top view of the propulsion mechanism of FIG. 3 generally taken along line 4-4 of FIG. 3, showing the brake pin engaged in the reverse drive and the fin disposed substantially in the extended position.
Figure 7:
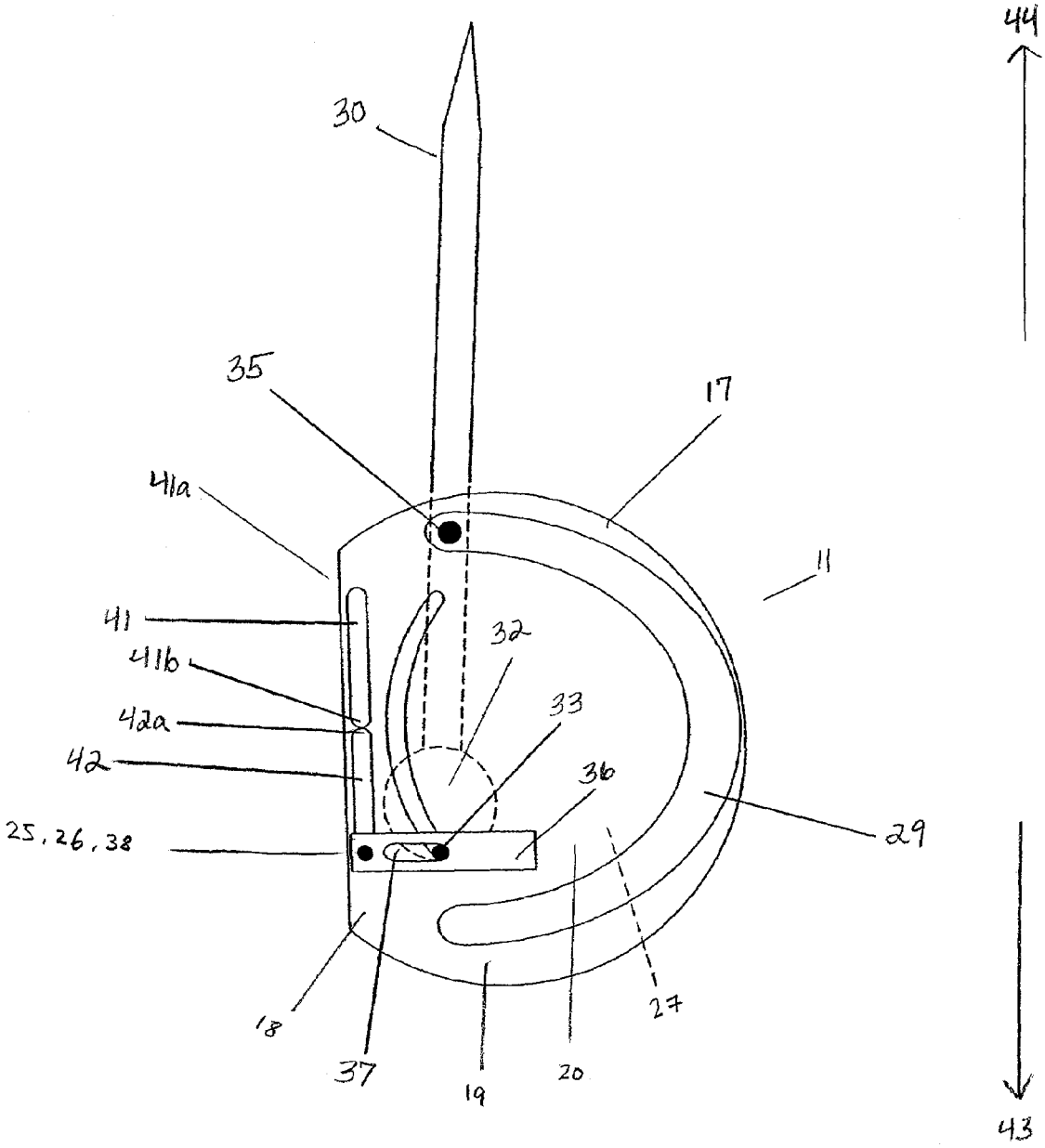
FIG. 7 is a view similar to FIG. 6, but showing the fin disposed substantially in the retracted position.

In forward drive, as shown in FIGS. 4-5, the front brake slot 41, inner and outer channels 28, 29, fin 30, and the inner and outer guide pins 33, 35 are spatially arranged such that the outer guide pin 35 is limited to moving within a range of from about 90 degrees to about 180 degrees along the outer channel 29, with 180 degrees being parallel to a first vector 43 that is parallel to the longitudinal axis A-A. In reverse drive, as shown in FIGS. 6-7, the rear brake slot 42, inner and outer channels 28, 29, fin 30, and the inner and outer guide pins 33, 35 are spatially arranged such that the outer guide pin 35 is limited to moving within a range of from about 0 degrees to about 90 degrees along the outer channel 29, with 0 degrees being parallel to a second vector 44 that is parallel to the longitudinal axis A-A. It will be appreciated that when the outer guide pin 35 is at 180 degrees, as shown in FIG. 4, the fin 30 is in a retracted position that is substantially parallel to the longitudinal axis A-A, tending to minimize water resistance as the intertial forces of the watercraft propel it through the water. It will further be appreciated that when the outer guide pin 35 is at about 90 degrees, as shown in FIGS. 5-6, the fin 30 is in an extended position that is substantially perpendicular the longitudinal axis A-A, tending to maximize water resistance when the fin 30 is disposed in the water.

If the propulsion mechanism 10 is in forward drive and the fin 30 in the retracted position as shown in FIG. 4, the user may initiate propulsion of the watercraft 12 by applying a force to the yoke 36, via the handle 40 or otherwise, along the first vector 43, causing the brake pin 26 to slide within front the brake slot 41 towards the second front stop 41*b*. As the brake pin 26 and yoke 36 move relative to the base 17, the inner guide pin 33 slideably moves within the inner channel 28 in a substantially arcuate path following the first vector 43, the outer guide pin 35 slideably moves within the outer channel 29 in a substantially arcuate path opposing the first vector 43. The opposing movement of the inner and outer guide pins 33, 35 cause the fin 30 to rotate about the first fin axis B-B toward the extended position, until the brake pin 26 is substantially abuts the second front stop 41*b* as shown in FIG. 5. It will be appreciated that when the inner guide pin 33 slideably moves along the arcuate path of the inner channel 28, the inner guide pin 33 slidably moves within the yoke channel 37, thereby permitting the yoke 36 to follow a substantially straight path that is substantially parallel to the first vector 43.

With the fin 30 in the extended position, forward propulsion may occur as the user continues to apply a force to the yoke 36 along the first vector 43 with the brake pin 26 in abutment with the second front stop 41*b*, thereby causing the base 17 and the fin 30 to slide along the track 15 toward the second position.

The user may return the fin 30 towards the first position by applying a force along the second vector 44, causing the brake pin 26 to move within the brake slot 41 towards the first front stop 41*a*. As the brake pin 26 moves relative to the base 17 toward the first front stop 41*a*, the inner guide pin 33 slidably moves within the inner channel 28 in a substantially arcuate path substantially following the second vector 44, and the outer guide pin 35 slideably moves within the outer channel 29 in a substantially arcuate path substantially opposing the second vector 44. The opposing movement of the inner and outer guide pins 33, 35 causes the fin 30 to rotate about the first fin axis B-B toward the retracted position until the brake pin 26 abuts the first front stop 41*a*, as shown in FIG. 4. As the user continues to apply the force to the yoke 36 along the second vector 44 with the brake pin 26 abutting the first front stop 41*a*, the yoke 36, base 17 and fin 30 move toward the first position with the fin 30 in a retracted position. The retracted position of the fin 30 minimizes water resistance allowing continued propulsion of the watercraft 12 due to inertial movement.

In an embodiment, the user may switch between forward and reverse drive using the clutch 25. The user may grip the clutch 25 to pull the brake pin 26 upwardly from the front brake slot 41, then slide and position the yoke 36 over the rear brake slot 42 and insert the brake pin 26 into the rear brake slot 42. In another embodiment, the clutch 25 and brake pin 26 may be integral with the extender 39 and handle 40, allowing the user to switch between forward and reverse drive by gripping only the handle 40 and pulling upwardly to slide the yoke 36 to the desired position. In this embodiment, the user may remove the brake pin 26 from the front brake slot 41 by pulling upwardly on the handle 40, reposition the yoke 36 to the desired location and insert the brake pin 26 into the second brake slot 42 by releasing the handle 40.

When the propulsion mechanism is in the reverse drive, as the user applies a force to the yoke 36 along the second vector 44, causing the base 17 to slide from the second position toward the first position along the track 15, the fin 30 is disposed in the extended position, thereby allowing reverse propulsion of the watercraft 12 caused by water resistance on the fin 30, as shown in FIG. 6 as disclosed in greater detail above. Conversely, as the user applies force to the yoke 36 along the first vector 43, causing the base 17 to move from the first position to the second position along the track 15, the fin 30 will be in a retracted position, thereby minimizing water resistance to allow continued propulsion of the watercraft 12, as shown in FIG. 7 as disclosed in greater detail above.

In another embodiment having dual propulsion mechanisms 10, as shown in FIG. 1, while one propulsion mechanism 10 is moved from the first position toward the second position, the other propulsion mechanism 11 may be simultaneously reciprocally moved from the second position toward the first position, similar to natural hand motions of a runner where one hand moves forwardly while the other hand moves rearwardly.

An embodiment having dual propulsion mechanisms 10 is capable of changing directions without use of a rudder. For example, the user may wish to rotate the body clockwise, i.e. a right turn. As such, the user puts the first propulsion mechanism 10 in reverse drive and the second propulsion mechanism 11 in forward drive. The opposing forces between the first and second propulsion mechanisms 10, 11 will cause the body to rotate clockwise relative to water, in a well-known manner.

Figure 8:
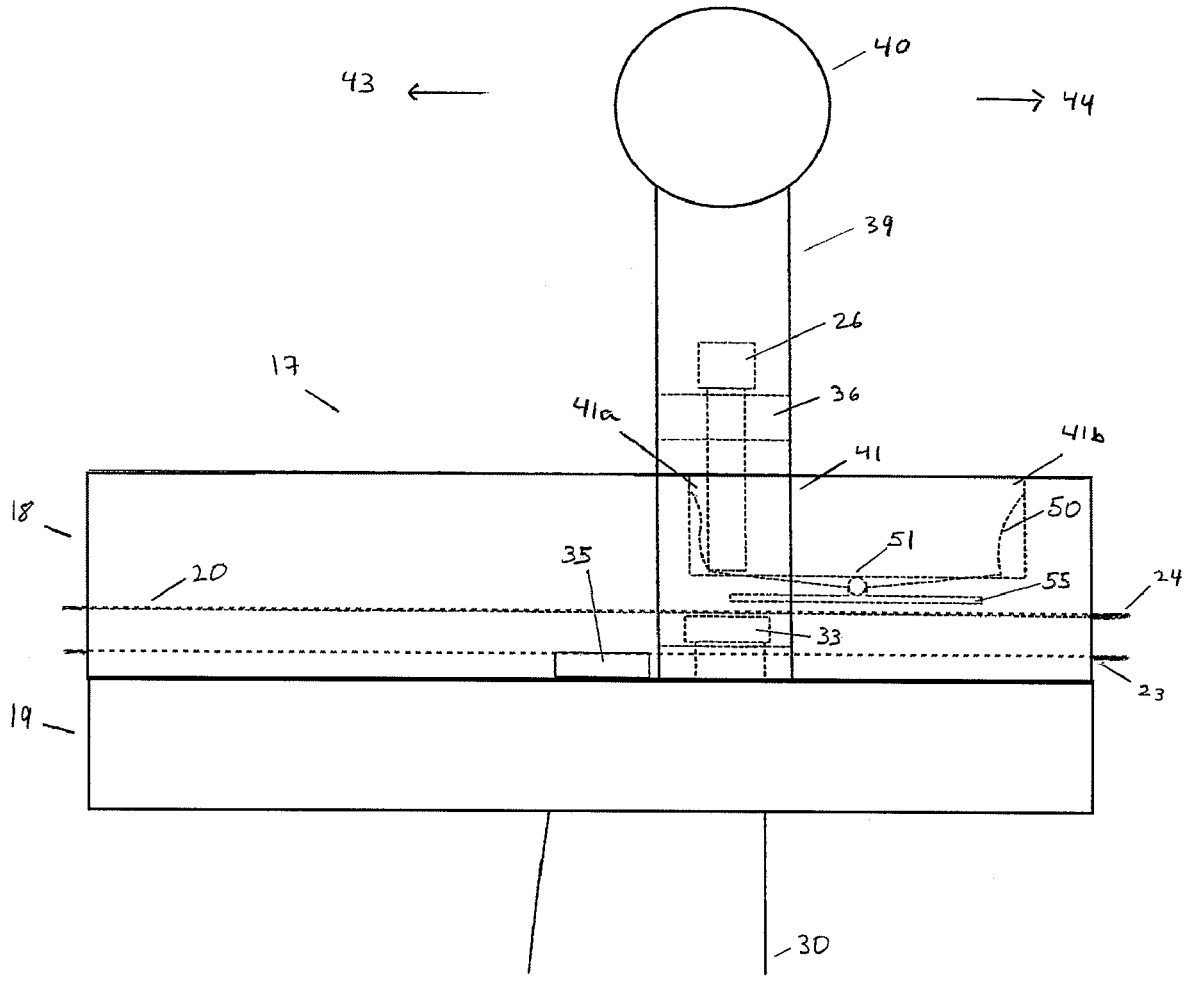
FIG. 8 is a view of an embodiment having a detent mechanism in a released condition.
Figure 9:
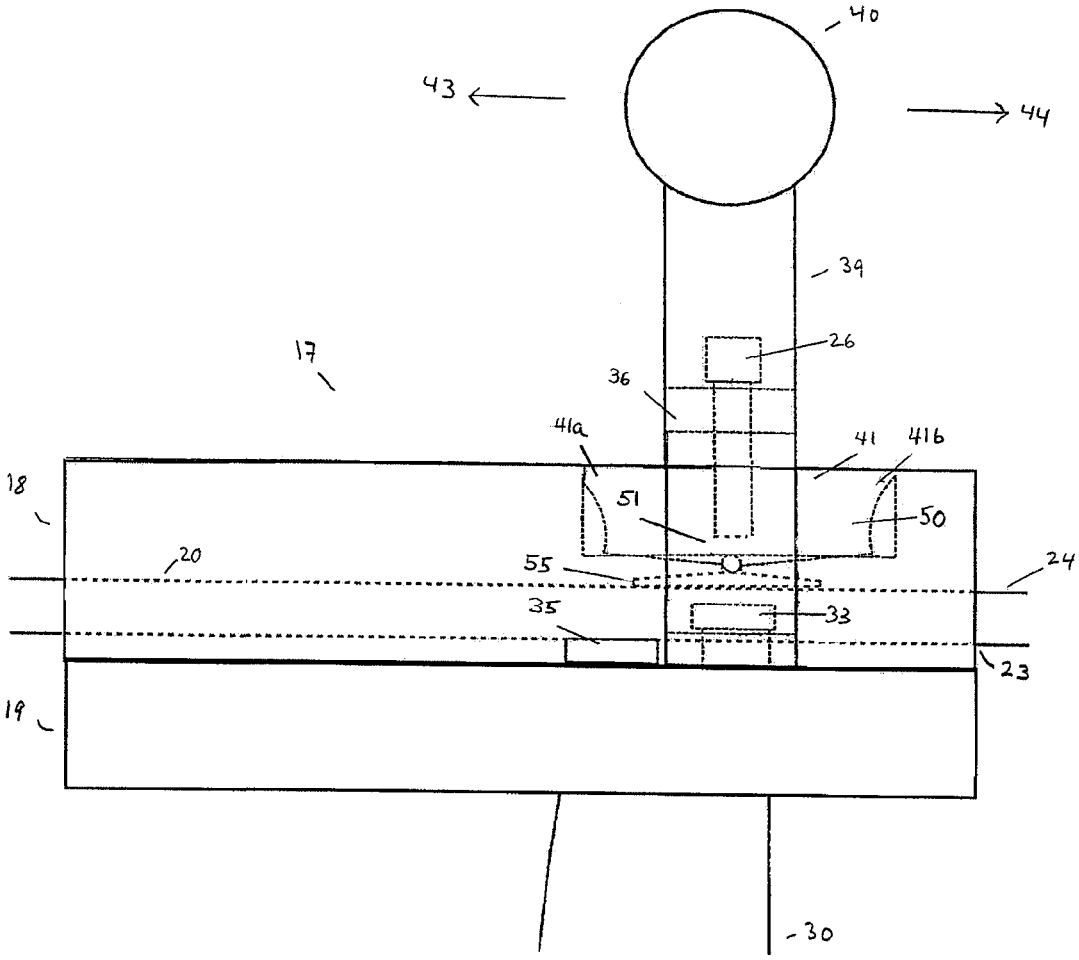
FIG. 9 is similar to FIG. 8, but showing the detent mechanism in a braking condition.

Referring to FIGS. 8-9, another embodiment of the propulsion mechanism 10 may additionally include a detent mechanism 50 disposed adjacent to the guide rail 24 for temporary detainment of the base 17 relative to the guide rail 24. The detent mechanism 50 may provide smoother operation of the propulsion mechanism by temporarily detaining the base 17 when the fin 30 is to be rotated, and by releasing the base 17 when the fin 30 is to be moved relative to the body. The detent mechanism 50 may comprise a spring actuated frictional brake mechanism 51 as disclosed in pending patent application Ser. No. 10/905,257, titled "Frictional Brake Mechanism," and filed on Dec. 22, 2004, which is incorporated herein by reference.

The frictional brake mechanism 51 may be adapted to detain the base 17 relative to the guide rail 24 by having a brake pad 55 for frictional engagement with the guide rail 24. As such, when the brake pad 55 frictionally engages the side wall of the guide rail 24, the detent mechanism 50 is in a braking condition as shown in FIG. 9.

Whether the frictional brake mechanism 51 is in a braking or released condition is determined by the user as the user controls the position of the brake pin 26 relative to the brake slot 41 by applying a force to the yoke 36 along a first or a second vector 43, 44. As such, when the brake pin 26 is substantially adjacent to the first or second front stops 41*a*, 41*b*, the frictional brake mechanism 51 is substantially in a released condition, as shown in FIG. 8, thereby releasing the base 17 and permitting movement of the fin 30 and base relative to the body 13 with the fin 30 in the extended or retracted position, as disclosed above. Further, when the brake pin 26 is substantially between the first and second front stops 41*a*, 41*b*, the frictional brake mechanism 51 is disposed in the detained condition thereby detaining the base 17 and further permitting rotation of the fin 30 toward an extended or retracted position.

It will be appreciated that an embodiment capable of reverse drive can have front and rear detent mechanisms. As such, the base may have a plurality of brake pins, a pair of front brake slots, a pair of rear brake slots, a front frictional brake mechanism for forward drive, and a rear frictional brake mechanism for reverse drive.

Figure 10:
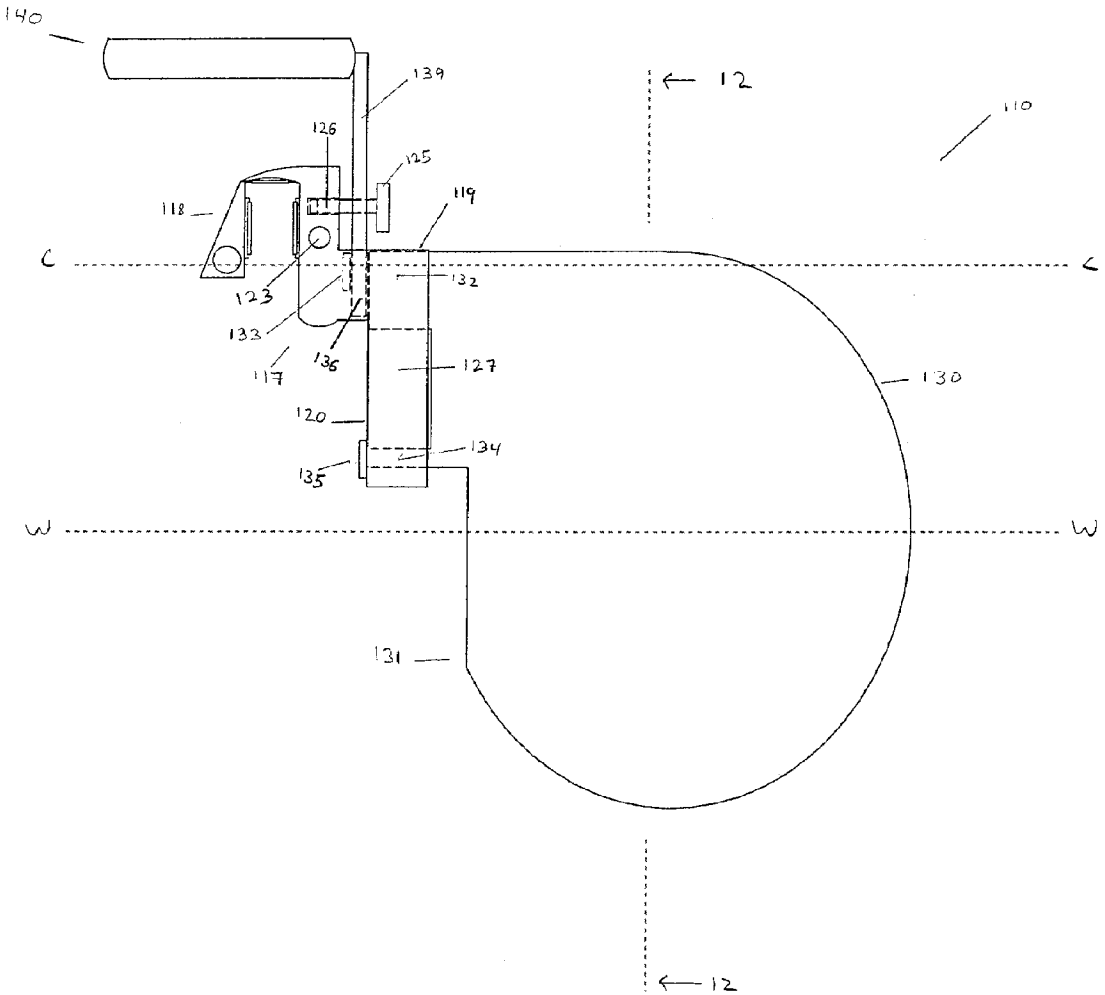
FIG. 10 is an enlarged side view of the propulsion mechanism showing the fin disposed substantially in the submerged position.
Figure 11:
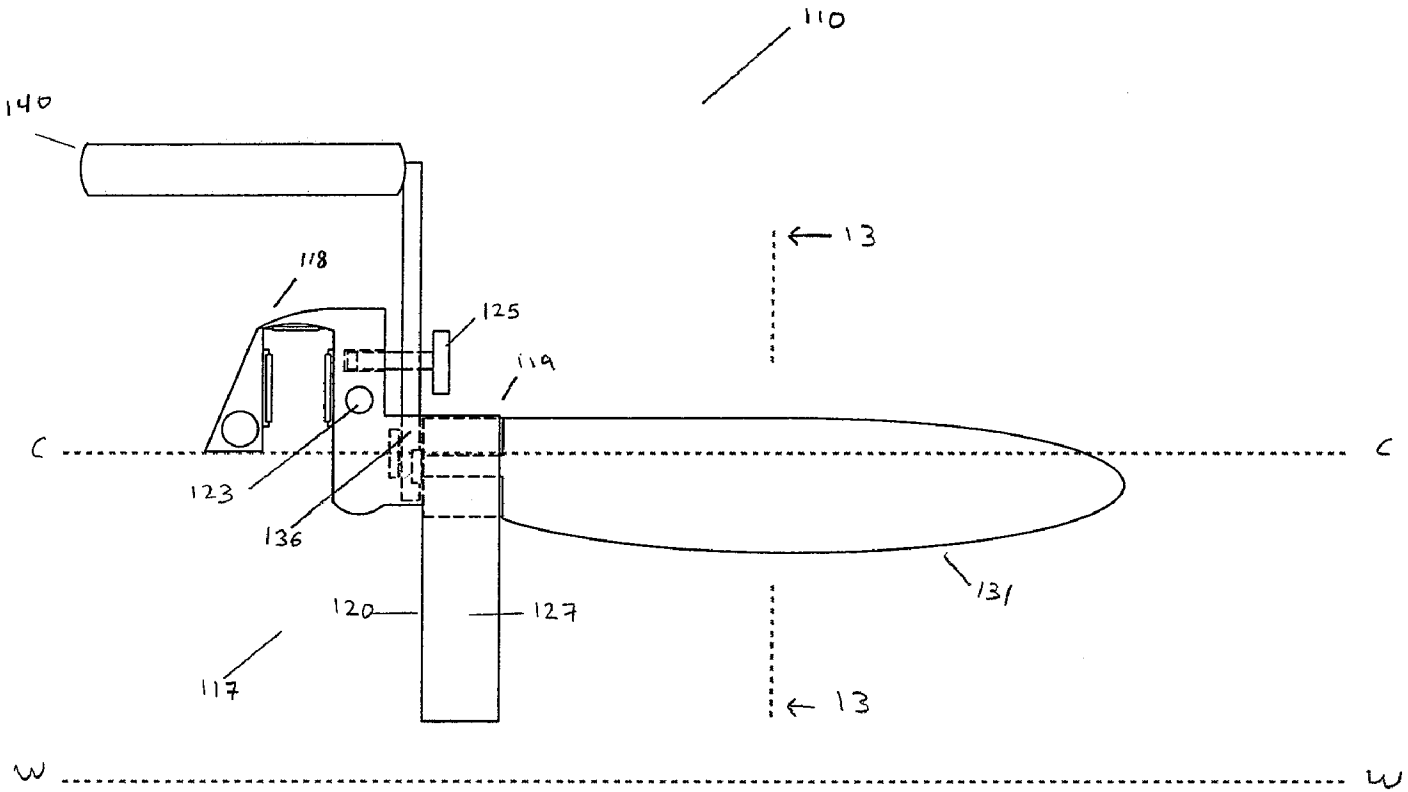
FIG. 11 is a view similar to FIG. 10, but showing the fin disposed substantially in the dry position.
Figure 12:
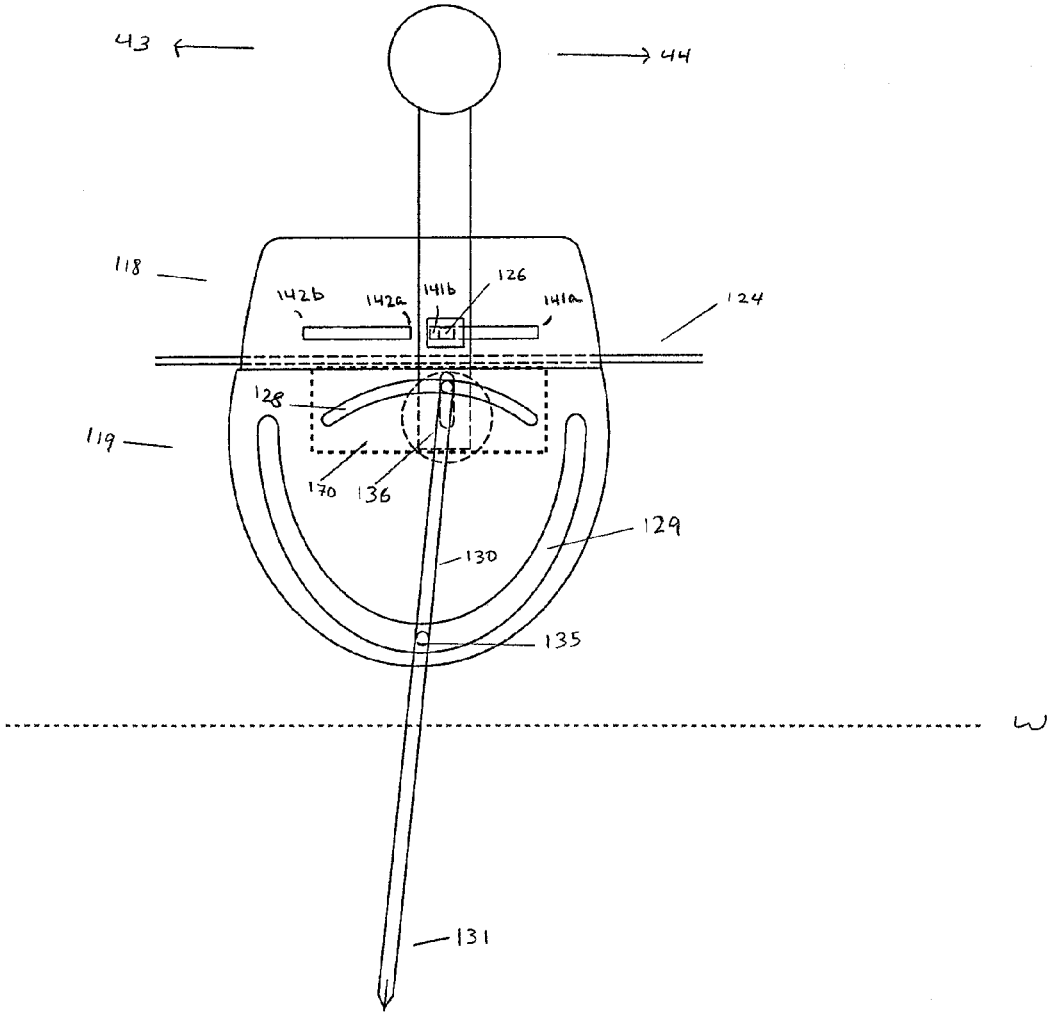
FIG. 12 is an enlarged side view of the wet-dry mechanism of FIG. 10 generally taken along line 12-12 of FIG. 10, showing the fin disposed substantially in the submerged position.

Referring also to FIGS. 10-13, another embodiment having an alternate arrangement of the base 117 and fin 130 is shown. In this embodiment of the propulsion mechanism 110, the fin 130 rotates about a second fin axis C-C, from a submerged position, as shown in FIGS. 10, 12, where the blade 131 of the fin 130 extends substantially downwardly such that the blade 131 is substantially submerged below the water surface, designated as W-W; and a dry position, shown in FIGS. 11, 13, where the blade 131 extends substantially toward the rear 13*b* of the watercraft, such that the blade is substantially parallel to and above the water surface W-W. It will be appreciated that the submerged position maximizes water resistance on the blade 131 and the dry position eliminates water resistance on the blade 131.

The base 117 of the alternate embodiment 110 includes a panel 118 and a shoulder 119 that is substantially vertically oriented. The embodiment may further include a clutch 125 coupled to a brake pin 126 that extends substantially horizontally toward the panel 118. The panel 118 includes a front brake slot 141 and rear brake slot 142, each disposed substantially parallel to the longitudinal axis A-A, and each adapted to engage the brake pin 126. It will be appreciated that the alternate embodiment 110 may include the detent mechanism 50 disposed adjacent to the guide rail 124 for temporary detainment of the base 117 relative to the guide rail 124, as discussed above.

Figure 13:
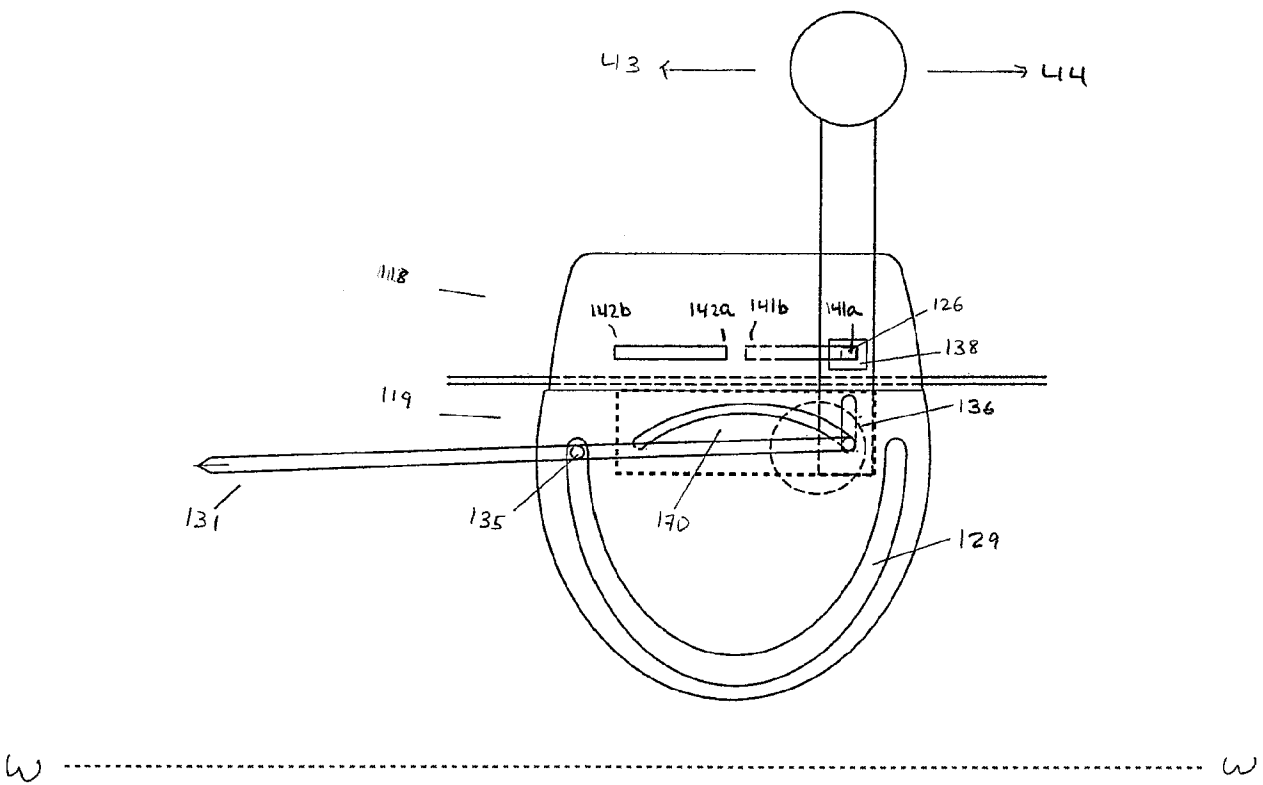
FIG. 13 is an enlarged side view of the wet-dry mechanism of FIG. 11 generally taken along line 13-13 of FIG. 11, showing the fin disposed substantially in the dry position.

The shoulder 119 includes a cap 120, disposed vertically, and a cavity 127 opening outwardly, away from the longitudinal axis A-A. Referring to FIGS. 12-13, the shoulder 119 further includes an inner channel 128 and outer channel 129 penetrating the cap 120, thereby exposing the cavity 127. The cavity 127 is adapted to receive the fin 130, which rotates about the second fin axis C-C. The fin includes an inner protrusion 132 and an outer protrusion 134 that are spaced apart relative to each other. The inner protrusion 132 moveably engages the inner channel 128 by having an inner guide pin 133 extending toward the inner channel 128 with a head disposed adjacent to the cap 120 and a shaft penetrating the inner channel 128. Similarly, the outer protrusion 134 engages the outer channel 129 by having an outer guide pin 135 extending toward the outer channel 129 with a head disposed above the cap 20 and a shaft penetrating the outer channel 129.

Referring to FIGS. 12-13, the alternate embodiment 110 includes an extender 139 with its lower portion forming a vertically oriented yoke 136. The vertically oriented yoke 136 is adapted to move within a channel 170 formed within the shoulder 118. The channel 170 is disposed substantially parallel to the longitudinal axis A-A. The vertically oriented yoke 136 includes a vertically oriented yoke channel 137, forming a substantially vertical path that is perpendicular to the longitudinal axis A-A and the second fin axis C-C. The inner guide pin 133 is adapted to engage the vertically oriented yoke channel 137 such that the head 133*a* is disposed adjacent an outer surface of the vertically oriented yoke 136. The vertically oriented yoke 136 is coupled to the brake pin 126 by having an aperture 138 adapted to effectuate removable engagement.

It will be appreciated that the alternate embodiment of the propulsion mechanism 110 operates in a manner that is substantially similar to the previously described embodiments, except, that in the alternate embodiment 110, the base 117 and vertically oriented yoke 136 are adapted to rotate the fin 130 about the second fin axis C-C rather than the first fin axis B-B.

In operation in forward drive when the fin 130 is in the dry position and the base 117 is in first position, the user may initiate propulsion of the watercraft 12 by applying a force to the vertically oriented yoke 136, via a handle 140, along the first vector 43. This causes the brake pin 126 to move within front the brake slot 141 towards the second front stop 141*b*. As the brake pin 126 and vertically oriented yoke 136 move relative to the base 117, the opposing movement of the inner and outer guide pins 133, 135 cause the fin 130 to rotate about the second fin axis C-C toward the submerged position shown in FIGS. 10, 12. With the fin 130 in the submerged position, forward propulsion may occur as the user continues to apply a force to the vertically oriented yoke 136 along the first vector 43, thereby causing the base 117 and fin 130 to move toward the second position.

Figure 14:
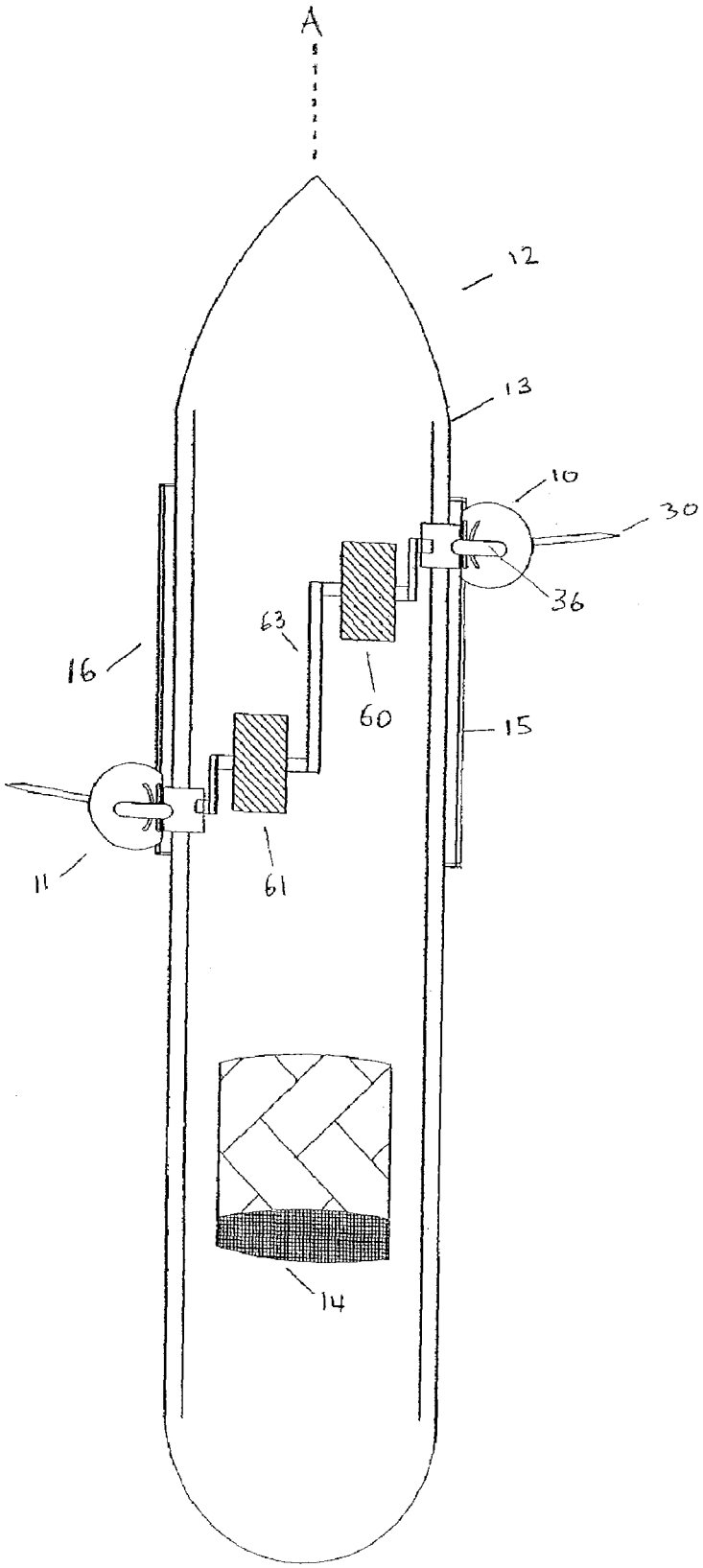
FIG. 14 is a top view of an embodiment depicting the propulsion mechanism coupled to bicycle-like foot propulsion pedals.

Referring also to FIG. 14, a foot actuated embodiment of the propulsion mechanism is shown. In the foot actuated embodiment, the user (not shown) applies a force to the yokes 36 using his or her feet. In such embodiment, the user may engage a right peddle 60 with his or her right foot and a left peddle 61 with his or her left foot. The right and left peddles 61, 62 may engage a crankshaft 63, which engages the yokes 36. As the user peddles in a well-known bicycle-like motion, the rotation of the crankshaft 63 causes a reciprocal force to be applied to the yokes 36. It will be appreciated that the foot powered embodiment could be adapted for use with the manually propelled propulsion mechanism 10 or the alternate embodiment 110. It will further be appreciated that a force could be applied to the yokes 36 in hand powered and foot powered embodiments, other than those disclosed in this application. Further, a force could be applied to the yokes 36 by means other than manually applied force, such as with a mechanical actuation device.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A device for propelling a watercraft having a longitudinal axis comprising:

a base having an inner channel and an outer channel disposed thereon, each channel forming a substantially arcuate path having a concave side, the channels being disposed in inverse, juxtaposed relation to each other, wherein the concave sides substantially face each other; and a fin being disposed substantially adjacent to the base and rotatable about a fin axis having a blade, an inner protrusion adapted to slidably engage the inner channel, and an outer protrusion adapted to slidably engage the outer channel.

2. The device of claim 1 further comprising:

a yoke disposed substantially adjacent to the base and adapted to engage the inner protrusion, wherein when a force is applied to the yoke along a first vector, the inner and outer protrusions move in reciprocal directions relative to each other thereby causing the fin to rotate about the fin axis.

3. The device of claim 2 further comprising:

a front brake slot disposed on a side of the base; and a brake pin coupled to the yoke and adapted to slidably engage the front brake slot.

4. The device of claim 3 further comprising:

a rear brake slot disposed on a side of the base; and the brake pin adapted to slidably engage the rear brake slot.

5. The device of claim 3 further comprising:

a track coupled to the watercraft and disposed substantially parallel to the longitudinal axis; and the base being adapted to slidably engage the track, thereby allowing the base to slide between a first position and a second position relative to the watercraft.

6. A device for propelling a watercraft having a body having a longitudinal axis and being adapted to substantially float on a water surface, comprising:

a track disposed on the body substantially parallel to the longitudinal axis;

a base having a panel and a shoulder, the base being adapted to slidably engage the track, thereby allowing the base to slide between a first position and a second position relative to the body;

a front brake slot disposed on a side of the panel forming a first front stop and a second front stop;

a inner channel and an outer channel disposed on a side of the shoulder, each forming a substantially arcuate path;

a fin disposed adjacent to the base having a blade, an inner protrusion adapted to slidably engage the inner channel, and an outer protrusion adapted to slidably engage the outer channel;

a yoke disposed adjacent to the base having a yoke channel that is adapted to be slidably engaged by the inner protrusion;

a brake pin coupled to the yoke and adapted to slidably engage the front brake slot; and wherein when a first force is applied to the yoke along a first vector, the inner and outer protrusions respectively slide within the inner and outer channels in reciprocal directions relative to each other, thereby causing the fin to rotate relative to the body.

7. The device of claim 6 where the fin is rotatable about a first fin axis that is substantially perpendicular to the water surface, wherein when the first force is applied to the yoke along the first vector, the brake pin slides within the front brake slot in a direction substantially following the first vector, thereby causing the blade to rotate about the first fin axis to an extended position that is substantially perpendicular to the longitudinal axis.

8. The device of claim 7 wherein when a second force is applied to the yoke along a second vector, the brake pin slides within the front brake slot in a direction substantially following the second vector, thereby causing the blade to rotate about the first fin axis to a retracted position that is substantially parallel to the longitudinal axis.

9. The device of claim 8 wherein when the first force is continually applied to the yoke along the first vector and the brake pin substantially abuts the second front stop, the base and fin slide from the first position toward the second position with the fin disposed substantially in the extended position.

10. The device of claim 9 wherein when the second force is continually applied to the yoke along the second vector and the brake pin substantially abuts the first front stop, the base and fin move from the second position toward the first position with the fin substantially in the retracted position.

11. The device of claim 6 wherein the fin is rotatable about a second fin axis that is perpendicular to the longitudinal axis and substantially parallel to the water surface, wherein when the first force is applied to the yoke along the first vector, the brake pin slides within the front brake slot in a direction substantially following the first vector, thereby causing the blade to rotate about the second fin axis to a substantially submerged position that is substantially perpendicular to the water surface.

12. The device of claim 11 wherein when a second force is applied to the yoke along a second vector, the brake pin slides within the front brake slot in a direction substantially following the second vector, thereby causing the blade to rotate about the second fin axis to a dry position that is substantially parallel to the water surface.

13. The device of claim 12 wherein when the first force is continually applied to the yoke along the first vector and the brake pin substantially abuts the second front stop, the base and fin slide from the first position toward the second position with the fin substantially in the submerged position.

14. The device of claim 13 wherein when the second force is continually applied to the yoke along the first vector and the brake pin substantially abuts the first front stop, the base and fin slide from the second position toward the first position with the fin substantially in the dry position.

15. The device of claim 6 further comprising a rear brake slot disposed on a side of the base, wherein the brake pin is adapted to slidably engage the rear brake slot.

16. The device of claim 6 further comprising a handle coupled to the yoke.

17. The device of claim 6 further comprising a peddle coupled to the yoke.

18. The device of claim 6 further comprising:

a front detent mechanism disposed substantially adjacent to the front brake slot for temporary detainment of the base relative to the body that is adapted to be in a braking condition when the brake pin is substantially between the first front and second front stops and adapted to be in a released condition when the brake pin is substantially adjacent to the first front or second front stops.

19. The device of claim 18 further comprising:

a guide rail disposed on the body substantially parallel to the longitudinal axis;

a guide bore disposed on the base slideably coupled to the guide rail; and the front detent mechanism having a spring actuated brake pad adapted to create a braking condition by frictionally engaging the upper guide rail.

20. The device of claim 18 further comprising:

a rear detent mechanism disposed substantially adjacent to the rear brake slot for temporary detainment of the base relative to the body.

21. A device for controlling the rotation of a fin having a blade about a fin axis relative to a watercraft, comprising:

a base adapted to be coupled to the watercraft and having an inner channel and an outer channel disposed thereon, each channel respectively forming a substantially arcuate path;

inner and outer protrusions coupled to the fin and respectively adapted to slidably engage the inner and outer channels;

a slot having first and second stops and disposed on a side of the base; and a yoke adapted to engage the inner protrusion and having a brake pin that is adapted to slidably engage the slot;

wherein when a force is applied to the yoke along a first vector, the inner and outer protrusions move in reciprocal directions relative to each other, thereby causing the blade to rotate about the fin axis when the brake pin moves from the first stop, wherein the blade is disposed in a substantially parallel position relative to the watercraft, to abut the second stop, wherein the blade is disposed in a substantially perpendicular position relative to the watercraft.

* * * * *